US007178466B2

(12) United States Patent
Raoul

(10) Patent No.: US 7,178,466 B2
(45) Date of Patent: Feb. 20, 2007

(54) RAILROAD CAR WITH SIDE AND INTERMEDIATE DOOR PROVIDING ACCESS TO THE INSIDE OF ITS BOX BODY, AND CORRESPONDING TRAIN

(75) Inventor: Jean-Claude Raoul, Yerres (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/810,172

(22) Filed: Mar. 26, 2004

(65) Prior Publication Data

US 2004/0200383 A1 Oct. 14, 2004

(30) Foreign Application Priority Data

Apr. 8, 2003 (FR) ..... 03 04352

(51) Int. Cl.
*B60N 5/00* (2006.01)

(52) U.S. Cl. ..... 105/329.1

(58) Field of Classification Search ..... 105/238.1, 105/280, 282.1, 329.1, 339, 340, 396, 397
See application file for complete search history.

(56) References Cited

U.S. PATENT DOCUMENTS 2,636,454 A * 4/1953 Clary ..... 105/340
2,698,569 A * 1/1955 Reynolds et al. ..... 454/105
3,822,493 A * 7/1974 Maley ..... 40/471
5,063,859 A * 11/1991 Rader ..... 105/340
6,578,795 B2 * 6/2003 Romca et al. ..... 244/122 R

FOREIGN PATENT DOCUMENTS

| | | |
|---|---|---|
| DE | 44 42 368 | 5/1996 |
| DE | 4442368 A1 * | 5/1996 |
| EP | 0 625 457 | 11/1993 |
| EP | 0 981 125 | 2/2000 |

OTHER PUBLICATIONS

Rapport de Recherche Preliminaire—FR 0304352—2 pgs.

* cited by examiner

*Primary Examiner*—S. Joseph Morano
*Assistant Examiner*—Robert J. McCarry, Jr.
(74) *Attorney, Agent, or Firm*—Timothy J. Olson; Arthur E. Fournier, Jr.

(57) ABSTRACT

A railroad car is provided having a box body extending longitudinally and delimiting compartments, seats arranged in the compartments, means for identifying the seats,means for identifying the car, and at least one side door providing access to the compartments. The side door is an intermediate door away from the longitudinal ends of the car and arranged longitudinally between two compartments provided with seats to which it provides access.

6 Claims, 1 Drawing Sheet

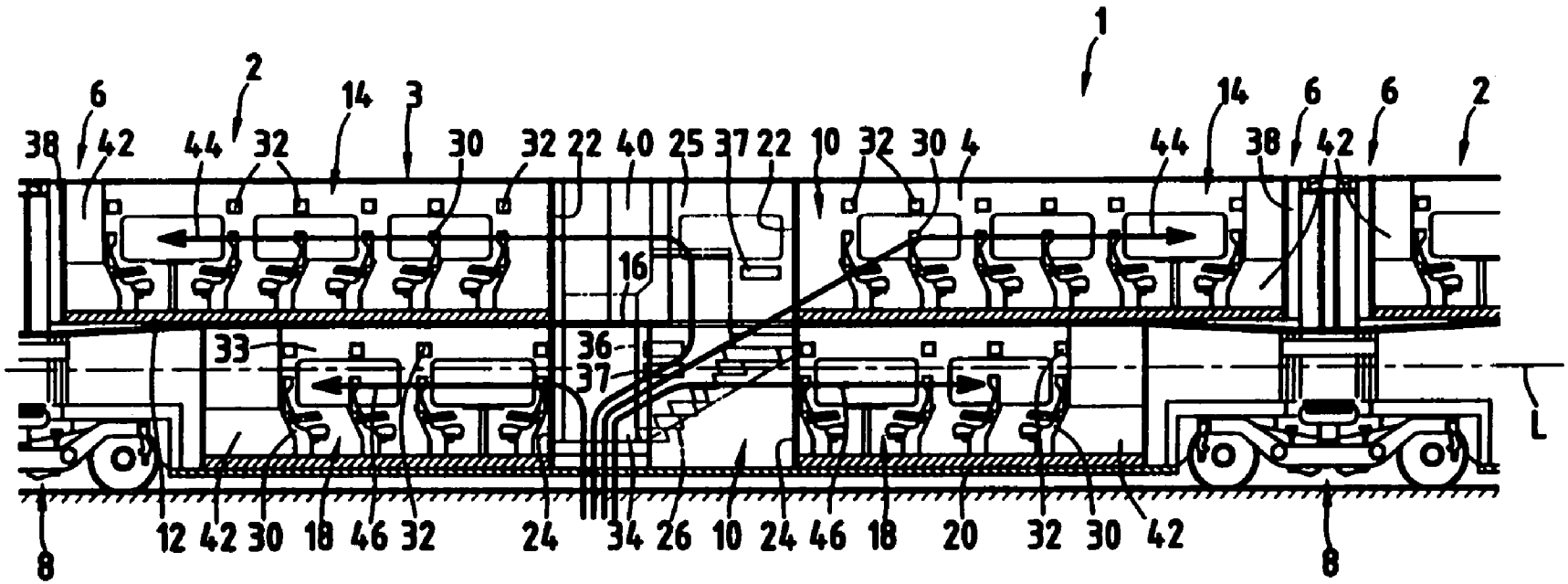
1
2
3
4
6
8
10
12
14
16
18
20
22
24
25
26
30
32
33
34
36
37
38
40
42
44
46
L

RAILROAD CAR WITH SIDE AND INTERMEDIATE DOOR PROVIDING ACCESS TO THE INSIDE OF ITS BOX BODY, AND CORRESPONDING TRAIN

BACKGROUND OF THE INVENTION

The present invention relates to a railroad car of the type comprising a box body extending longitudinally and delimiting compartments, seats arranged in the compartments, means for identifying the seats, means for identifying the car, and at least one side door providing access to the compartments.

In particular, the invention relates to railroad cars that are to travel at high speed, i.e. speeds in excess of approximately 270 km/h.

Cars of the abovementioned type, for example with two stories, are known. Such cars each comprise, at a longitudinal end, two side access doors provided in the side walls of the box body. These side doors provide access via a lower landing to the compartment of the lower story and, by means of a staircase and an upper landing, to the compartment of the upper story.

When a plurality of such cars are hitched up together to form a train, it is also possible to move longitudinally from the upper compartment of one car to the upper compartment of an adjacent car via connecting doors provided at the longitudinal ends of the cars.

It has been observed that such cars have a number of drawbacks.

Thus, passengers encounter problems in locating and gaining access to the seats allocated to them when they make a reservation.

Indeed, despite the means identifying the car, which are generally provided near the side access doors, many passengers select the wrong car and enter a car adjacent to the one in which their seat has been reserved.

This gives rise to opposing flows of passengers that make access to seats tedious and time-consuming, all the more so when trains stop at stations where passengers have to leave the cars and others have to enter in order to gain access to their seats.

This situation is exacerbated by the long distances to be covered from the access doors of a car in order to reach the seats arranged at the other longitudinal end of the car.

Lastly, the length of the lower compartments of such cars, which constitute dead ends, further increases passengers' difficulty of access to the seats they have reserved.

SUMMARY OF THE INVENTION

An object of the invention is to solve this problem by providing a car of the abovementioned type that enables passengers to locate and to gain access more easily and more rapidly to the seats they have reserved.

To this end, a subject of the invention is a railroad car of the abovementioned type wherein the side door is an intermediate door away from the longitudinal ends of the car and arranged longitudinally between two compartments provided with seats to which it provides access, the side door being placed so as to define two compartments whose lengths are approximately the same.

According to particular embodiments, the car may comprise one or more of the following characteristics, taken in isolation or in accordance with all technically possible combinations:

- it comprises means for indicating the distribution of seats between the compartments;
- it comprises a space, providing access to the compartments, arranged longitudinally between said two compartments, and the indication means are arranged in the access space;
- the box body comprises two stories, each story including two compartments and a landing arranged longitudinally between the two compartments for providing access thereto, and the vehicle comprises at least one internal staircase for moving from one landing to the other;
- the side access door is arranged longitudinally substantially in the center of the car;
- the box body includes two intermediate side access doors provided in opposite side walls of the box body;
- it does not comprise a side access door at its longitudinal ends;
- it comprises, at its longitudinal ends, doors providing access longitudinally to a compartment of an adjacent railroad car.

A further subject of the invention is a train comprising a plurality of railroad cars hitched up together wherein the cars are cars as defined above.

According to a variant embodiment, the adjacent longitudinal ends of two adjacent cars are supported by a common bogie.

BRIEF DESCRIPTION OF THE DRAWINGS

The invention will be better understood on reading the following description given solely by way of example with reference to the single attached FIGURE that is a partial diagrammatic view in longitudinal and mid-plane section of a train according to the invention.

DETAILED DESCRIPTIONS OF THE PREFERRED EMBODIMENT

The sole FIGURE of the drawings illustrates a train 1 comprising a plurality of railroad cars hitched up together. As the railroad cars 2 have similar structures, only one will be described below.

The car 2 comprises a box body 3 extending longitudinally in a direction L and delimiting a compartment 4 on the inside. The longitudinal ends 6 of the car 2 are hitched up to the longitudinal ends 6 of adjacent cars 2. Each pair of longitudinal ends 6 hitched up to one another rests on a common bogie 8.

The box body 3 comprises two stories 10 separated by a floor 12.

The upper story 10 comprises two compartments 14, for receiving passengers, separated by a landing 16 providing longitudinal access to the compartments 14.

The lower story 10 comprises two compartments 18, for receiving passengers, separated by a landing 20 providing longitudinal access to the compartments 18.

Doors 22 and 24 are provided, respectively, between the landing 16 and the compartments 14 and between the landing 20 and the compartments 18.

The doors 22 and 24 and the landings 16 and 20 delimit, in the box body 3, an interior space 25 providing access to the compartments 14 and 18.

An interior staircase 26 (in broken line) is provided in the space 25 for moving from the upper landing 16 to the lower landing 20, and vice versa.

The landings 16 and 20 are away from the longitudinal ends 6 of the car 2 and are arranged longitudinally substantially in the center of the car.

Each compartment 14, 18 comprises seats 30 whose arrangement may be different in each of the compartments 14 and 18.

Each compartment 14, 18 comprises interior means 32 for identifying the seats 30. These may, for example, be elements placed facing the seats 30 on the adjacent side wall 33 of the box body 3 and bearing numbers for identifying the seats 30. In the variant embodiment, these may also be elements arranged on the backs of the seats 30.

Each side wall 33 of the box body 3 comprises, in line with the lower landing 20, a side door 34 providing lateral access to the inside of the box body 3. Such a door 34 may have a conventional structure and opens onto the lower landing 20 in the space 25.

Each side wall 33 includes, preferably near the door 34, exterior means 36 for identifying the railroad car 2. These means 36 can be seen in broken line in the FIGURE. These may, for example, be numerical signs indicating a number pre-allocated to the car 2.

The side walls 33 may also comprise, in line with the landings 16 and 20, interior means 37 for indicating all the numbers of seats 30 located in each compartment 14 and 18. These may be sign supports, numerical signs, etc. These means 37 thus indicate the distribution of the seats 30 between the compartments 14 and 18.

At the longitudinal ends 6 of the railroad car 2, the box body 3 comprises connecting doors 38 allowing movement longitudinally from the upper story 10 of the railroad car 2 to the upper story 10 of the adjacent railroad cars 2.

It will be noted that the railroad car 2 does not comprise a side access door provided at the longitudinal ends 6 of the railroad car 2.

The box body 3 comprises, for example, rest rooms 40 located on the landings 16 and 20. The lower rest rooms 40 are not visible in the FIGURE.

The upper compartments 14 comprise locations 42 for luggage storage. These locations 42 may be distributed along the compartments 14 or arranged at one or other of their longitudinal ends.

The lower compartments 18 also comprise such locations 42, which are, for example, provided at their longitudinal ends.

When a passenger has reserved a seat in the train 1, he will have been provided with information enabling him to identify the relevant seat 30 and the car 2 in which that seat is located, for example a seat number and a car number.

The passenger must first of all locate the car 2 using its identification means 36 and enter it via one of the doors 34. The risks of the passenger wrongly identifying the car 2 are reduced because the side access doors 34 are intermediate doors away from the ends 6 of the cars 2. The passenger is therefore unlikely to believe that the access door 34 he is using is in fact the door to an adjacent car 2. This reduction in the likelihood of error thus restricts opposing flows of passengers inside the cars 2.

Once the passenger has entered the car 2 and is on the lower landing 20, he can gain access to each of the upper compartments 14 via the staircase 26 and the upper landing 16, as shown by the arrows 44 in the FIGURE. He may also gain direct access to the lower compartments 18, as shown by the arrows 46 in the FIGURE.

By virtue of the means 37 indicating the distribution of the seats 30 in the compartments, the passenger is able, when he is in the space 25, to locate the compartment 14 or 18 where his seat is located and to go directly toward that compartment in order there to find the seat 30 allocated to him.

This reduces the likelihood of a passenger wrongly entering a compartment 14 or 18 when the seat 30 allocated to him is not located therein, and thus reduces opposing flows in the cars 2.

Lastly, as the lengths of each compartment 14, 18 are reduced, the drawbacks arising from possible opposing flows of passengers are less and the dead-end effect encountered in the lower compartments 18 is also diminished.

Thus, passengers may much more rationally, and therefore much more simply and rapidly, find the car 2 and the precise location of the seat 30 allocated to them. Furthermore, access to the seats 30 is much simpler and more rapid owing to the distribution of the flow of passengers into four different, relatively uniform streams, as shown by the arrows 44 and 46.

Moreover, the presence of four distinct and separate compartments 14 and 18 in each car 2 makes it possible to allocate each of these compartments to different groups of people, for example to families, to smokers, to non-smokers, and so on.

This makes it possible to limit the annoyance that one category of passenger may cause another category of passenger, and also, as set forth above, reduces the likelihood of error when a seat allocated to a traveler is being sought.

In certain cars 2, one of the compartments 14 or 18 may be provided with a counter and tables in order to form a bar/dining car. Certain compartments 18 may also be set aside for plant of all kinds (luggage compartment, electrical plant, etc.).

In another embodiment that is not shown, the box body 3 of one or of each car 2 may comprise an intermediate landing, arranged between the upper landing 16 and the lower landing 20 and providing access to the platforms 16 and 20 by means of interior staircases. The side doors 34 then open out onto this intermediate landing that is arranged longitudinally between at least two compartments 14 or 18 of the car 2 in question.

In certain variant embodiments that have not been shown, it will be noted that side access doors may, in addition to the intermediate doors 34, be provided at the longitudinal ends of the cars 2.

In yet a further variant embodiment, the indication means 37 may be absent from the space 25.

It will be noted that the principles set forth above, enabling passengers much more rationally to identify the cars 2 and the seats 30 and more easily to gain access to them, may be used in cars 2 with a single story. In such a case, the intermediate access doors 34 are arranged longitudinally between two lower compartments 18.

The specification incorporates by reference herein the French priority document FR 0304352 filed Apr. 8, 2003.

While the invention has been illustrated and described as embodied in specific embodiments, it is not intended to be limited to the details shown, since various modifications and structural changes may be made without departing in any way from the spirit of the present invention.

What is claimed is:

1. A railroad car comprising:

a box body extending longitudinally between a first end of said box body and a second end of said box body, said box body including a first compartment and a second compartment on a first story of said box body and a first compartment and a second compartment on a second story of said box body;

a first landing arranged so as to extend longitudinally between said first compartment and said second compartment of said first story;

a second landing arranged so as to extend longitudinally between said first compartment and said second compartment of said second story;

a single staircase between said first landing and said second landing;

seats arranged in said first and second compartments of said first story and in said first and second compartments of said second story;

a single door provided at each of said first end and said second end of said box body, said door on said first end and said door on said second end each being located at said second story of said box body for providing access between said second story of said railroad car at least one other adjacent railroad car;

a bogie positioned at each of said first end and said second end of said box body, said first story of said box body being positioned between said bogies, thereby preventing access between said first story of said railroad car said at least one other adjacent railroad car; and a means for enabling passengers to locate and to gain access to reserved ones of said seats while preventing opposing flows of said passengers, said means comprising:

at least one side door provided in said box body intermediate said first end and said second end of said box body operable for providing passengers with access to said first landing;

an exterior means for identifying said railroad car, said exterior means being positioned on said railroad car proximate said at least one side door so as to enable a passenger to readily determine an identity of said railroad car by reference to said exterior means;

a first interior means for identifying said seats that are arranged in each of said first and second compartments of said first story and in each of said first and second compartments of said second story, said first interior means including:

a first portion positioned proximate said first landing so as to enable a passenger entering said railroad car through said at least one side door to readily determine by reference to said first portion which of said first and second compartments on said first story and said first and second compartments on said second story includes a particular one of said seats, and a second portion positioned proximate said second landing so as to enable a passenger entering said second landing via said single staircase to readily determine by reference to said second portion which of said first and second compartments on said second story includes a particular one of said seats; and a second interior means for identifying each of said seats, said second interior means being located within said first and second compartments of said first story and within said first and second compartments of said second story so as to enable a passenger entering said first or second compartment of said first story or said first or second compartment of said second story to readily identify by reference to said second interior means a particular one of said seats.

2. A railroad car in accordance with claim 1, further comprising a door disposed between each of:

said first compartment of said first story and said first landing;

said second compartment of said first story and said first landing;

said first compartment of said second story and said second landing;

said second compartment of said second story and said second landing.

3. A railroad car in accordance with claim 1, wherein said exterior means includes a sign identifying said railroad car.

4. A railroad car in accordance with claim 1, wherein said first portion of said first interior means includes a sign indicating numbers associated with said seats in said first and second compartments of said first story and said seats in said first and second compartments of said second story, and said second portion of said first interior means includes a sign indicating numbers associated with said seats in said first and second compartments of said second story.

5. A railroad car in accordance with claim 1, wherein said second interior means includes at least one of:

elements placed facing said seats on a portion of said box body; and elements placed on said seats.

6. A train comprising a plurality of railroad cars in accordance with claim 1 hitched up to one another, wherein adjacent railroad cars in said plurality of railroad cars share a common bogie.

* * * * *